US009037071B2

(12) United States Patent
Shima

(10) Patent No.: US 9,037,071 B2
(45) Date of Patent: May 19, 2015

(54) IMAGE FORMING APPARATUS

(71) Applicant: Canon Kabushiki Kaisha, Tokyo (JP)

(72) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/263,277

(22) Filed: Apr. 28, 2014

(65) Prior Publication Data

US 2014/0334860 A1 Nov. 13, 2014

(30) Foreign Application Priority Data

May 8, 2013 (JP) ..... 2013-098772

(51) Int. Cl.
*G03G 21/12* (2006.01)

(52) U.S. Cl.
CPC ..... *G03G 21/12* (2013.01)

(58) Field of Classification Search
CPC G03G 21/10; G03G 21/12; G03G 2221/1624
USPC ..... 399/360, 35, 120
See application file for complete search history.

(56) References Cited

U.S. PATENT DOCUMENTS 4,500,196 A * 2/1985 Shimura ..... 399/35
5,260,755 A * 11/1993 Imaizumi ..... 399/35
5,398,098 A * 3/1995 Fukunaga et al. ..... 399/110
5,581,342 A * 12/1996 Yamauchi ..... 399/123
2008/0095547 A1* 4/2008 Kubo ..... 399/35
2011/0110694 A1 5/2011 Ishikake

FOREIGN PATENT DOCUMENTS

JP Sho 63-174088 A 7/1988
JP 2009-104217 A 5/2009
JP 2011-107175 A 6/2011

OTHER PUBLICATIONS

Machine translation of reference Muto (Pub No. JP 2000-010,409 A) Pub date Jan. 14, 2000.*

* cited by examiner

*Primary Examiner* — Rodney Bonnette
(74) *Attorney, Agent, or Firm* — Fitzpatrick, Cella, Harper & Scinto

(57) ABSTRACT

An image forming apparatus includes: a collecting container, provided detachably mountable to a casing of the image forming apparatus, capable of collecting a developer; a locked portion provided on the collecting container; a locking portion, provided on the casing, for locking the collecting container to prevent the collecting container from moving in a demounting direction by being locked with the locked portion when the collecting container is mounted in a main assembly of the image forming apparatus in an empty state; and a supporting portion for supporting the collecting container, the supporting portion being provided so as to be displaceable, by a weight of the developer collected by the collecting container, in a direction such that locking with the locking portion is released.

8 Claims, 7 Drawing Sheets

(a)

(b)

(a)

(b)

(a)

(b)

IMAGE FORMING APPARATUS

FIELD OF THE INVENTION AND RELATED ART

The present invention relates to an image forming apparatus in which a collecting container in which a collected developer is accumulated is demountable from a casing of the image forming apparatus, and particularly relates to a structure for positionally holding the collecting container at a predetermined position of the casing of the image forming apparatus.

The image forming apparatus in which the developer collected from a developing device, a belt cleaning device, a photosensitive drum and the like is collected and accumulated in the collecting container disposed in the casing of the image forming apparatus has been widely used. In recent years, with upsizing of the collecting container, there is a tendency that a difference in weight between an empty collecting container and a full collecting container becomes large.

The empty collecting container is light and therefore is liable to cause vibration, so that there is a possibility of movement in the image forming apparatus when various urging forces act on the empty collecting container, and therefore the empty collecting container may desirably be positioned at a predetermined position of the casing by providing a constraint band or a locking mechanism.

Japanese Laid-Open Patent Application (JP-A) 2009-104217 discloses an image forming apparatus in which a collecting container is disposed so as to be horizontally pullable out toward a front side of the image forming apparatus. With an operation for pushing the collecting container into a casing of the image forming apparatus, a supply path-side shutter member provided in a supply path along which a developer is dropped into the collecting container is opened. A slide-type locking mechanism holds down the collecting container likely to project from the casing by an urging force of a spring for urging the supply path-side shutter in a closing direction, thus positioning and holding the collecting container at a predetermined position of the casing.

The slide-type locking mechanism described in JP-A 2009-104217 cannot remove the collecting container from the image forming apparatus unless the locking mechanism is manually released.

SUMMARY OF THE INVENTION

A principal object of the present invention is to provide an image forming apparatus capable of locking a collecting container so as not to move from a mounting position in a demounting direction in the case where the collecting container is mounted in a main assembly at the mounting position in an empty state and capable of lock-releasing (eliminating) the collecting container by a weight of the collecting container in the case where a developer is accommodated and becomes full.

According to an aspect of the present invention, is to provide an image forming apparatus comprising: a collecting container, provided detachably mountable to a casing of the image forming apparatus, capable of collecting a developer; a locked portion provided on the collecting container; a locking portion, provided on the casing, for locking the collecting container to prevent the collecting container from moving in a demounting direction by being locked with the locked portion when the collecting container is mounted in a main assembly of the image forming apparatus in an empty state; and a supporting portion for supporting the collecting container, the supporting portion being provided so as to be displaceable, by a weight of the developer collected by the collecting container, in a direction such that locking with the locking portion is released.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings.

Embodiment 1

Figure 1:
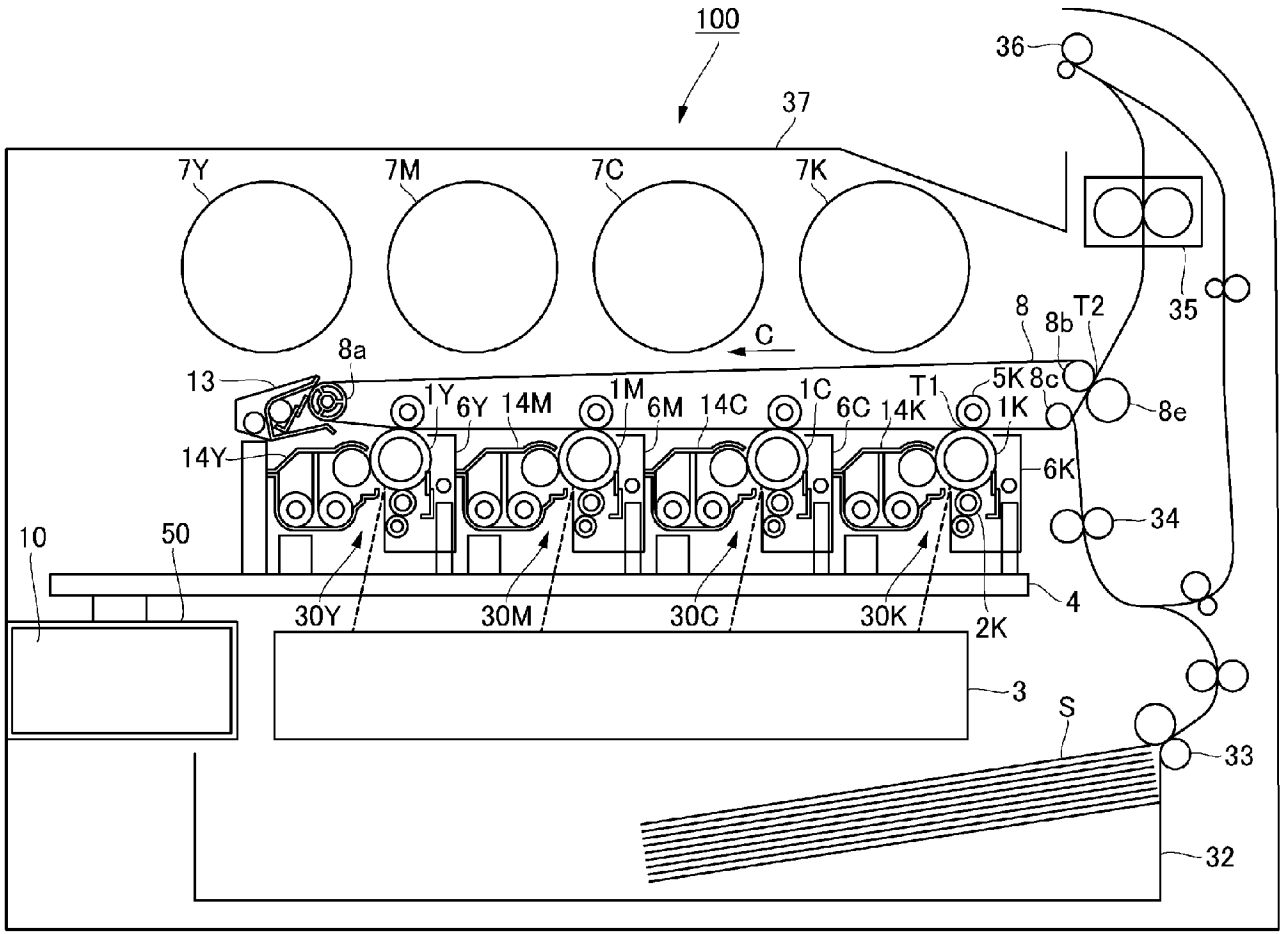
FIG. 1 is an illustration of a structure of an image forming apparatus.

As shown in FIG. 1, a collected toner container 10 as an example of a collecting container is detachably mounted in a casing of an image forming apparatus and is capable of accumulating a developer. A pipe 4 as an example of a supply path permits supply of the developer, collected in the image forming apparatus, to the collected toner container 10.

Figure 3:
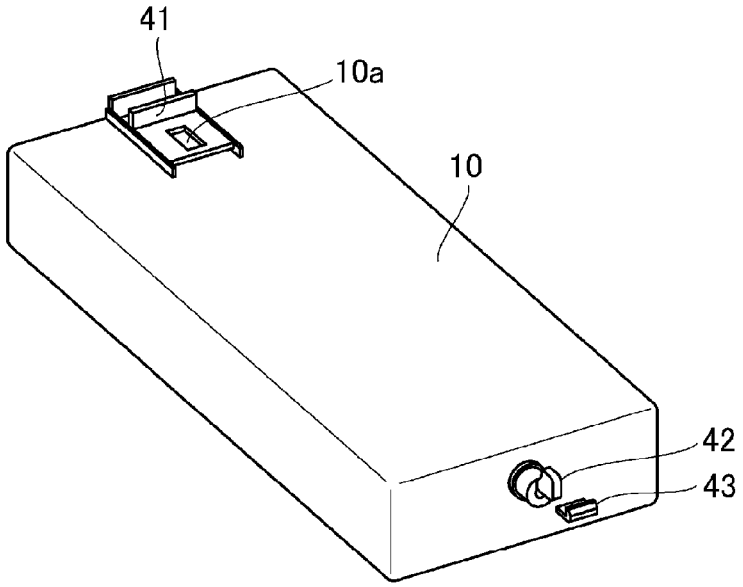
In FIG. 3, (a) is a perspective view of a collected toner container, and (b) is a sectional view of the collected toner container.
Figure 3:
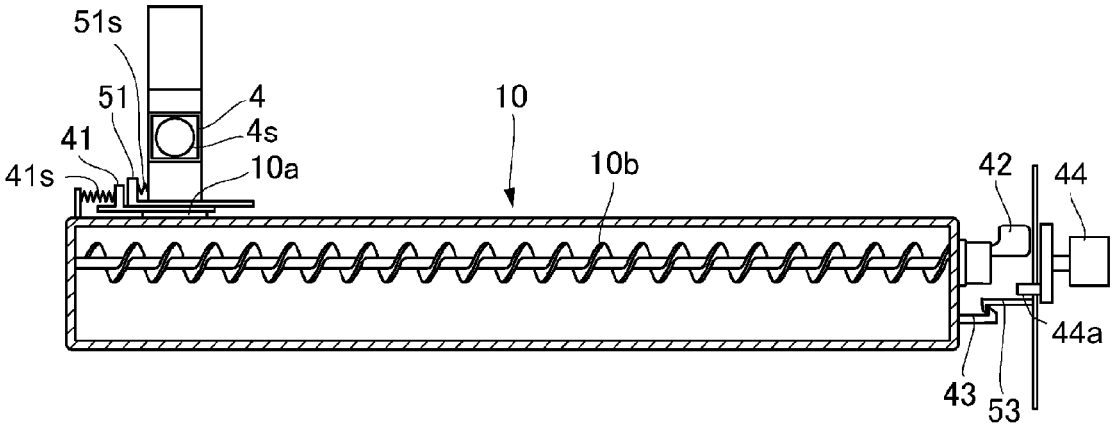

As shown in (b) of FIG. 3, a locking portion 53 as an example of a locking portion is provided in the casing of the image forming apparatus, and is locked with a locking claw 43 as an example of a locked portion (portion-to-be-locked) to position and hold the collected toner container 10 at a predetermined position. The collected toner container 10 includes the locking claw 43. The locking claw 43 is provided at a rear end surface of the collected toner container 10 with respect to a pulling-out direction. The locking portion 53 and the locking claw 43 are constituted so that a degree of locking between the locking portion 53 and the locking claw 43 is increased when the locking claw 43 is moved in an upward direction and is decreased when the locking claw 43 is moved in a downward direction.

Figure 4:
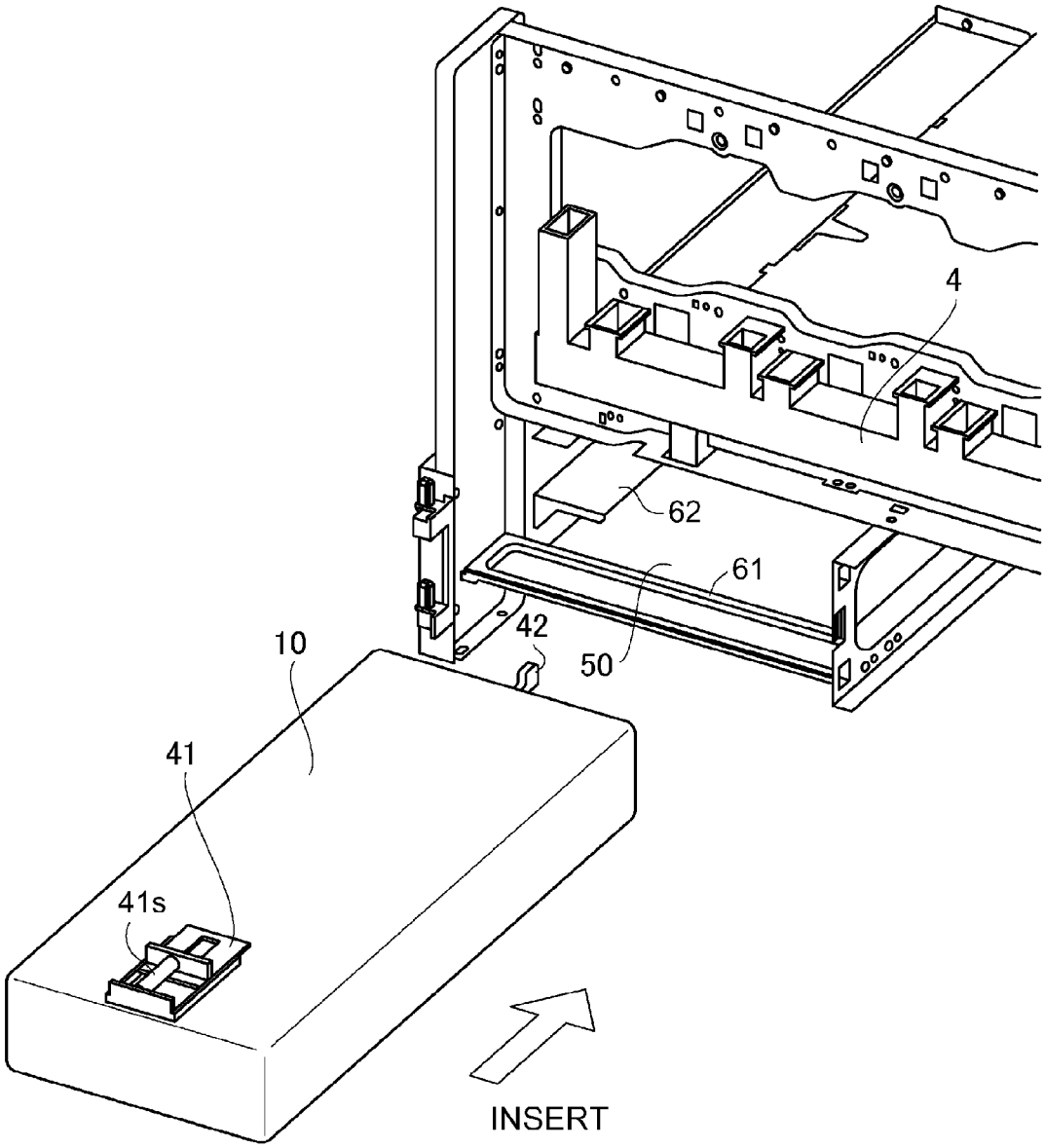
FIG. 4 is an illustration of a structure of a container accommodating portion.

As shown in FIG. 4, a container accommodating portion 50 as an example of a supporting portion guides the collected toner container 10 in a horizontally pullable out manner. The container accommodating portion 50 supports the collected toner container 10 so that a position of the collected toner container 10 is displaceable in a direction such that the locking between the locking portion 53 and the locking claw 43 is released (eliminated) depending on a weight increase of the collected toner container 10 with accumulation of the developer.

The container accommodating portion 50 lowers a supporting position of the collected toner container 10 with the weight increase of the collected toner container 10. The container accommodating portion 50 has a structure such that a rear side of the collected toner container 10 with respect to the pulling-out direction is lowered with the weight increase of the collected toner container 10, in a state in which a height position of the collected toner container 10 in a front side with respect to the pulling-out direction is maintained.

A cover member 62 as an example of a soft elastic member lowers the rear side of the collected toner container 10 with respect to the pulling-out direction with the weight increase of the collected toner container 10 by supporting a bottom of the collected toner container 10 along the pulling-out direction in a cantilever state.

(Image Forming Apparatus)

FIG. 1 is an illustration of a structure of an image forming apparatus 100. As shown in FIG. 1, the image forming apparatus 100 is an intermediary transfer type full color printer of a tandem type in which image forming portions 30Y, 30M, 30C and 30K are arranged along a downward surface of an intermediary transfer belt 8.

At the image forming portion 30Y, a yellow toner image is formed on a photosensitive drum 1Y and then is transferred onto the intermediary transfer belt 8. At the image forming portion 30M, a magenta toner image is formed on a photosensitive drum 1M and then is transferred onto the intermediary transfer belt 8. At the image forming portions 30C and 30K, cyan and black toner images are formed on photosensitive drums 1C and 1K, respectively, and then are transferred onto the intermediary transfer belt 8.

The four color toner images transferred on the intermediary transfer belt 8 are conveyed to a secondary transfer portion T2 and are secondary-transferred onto the recording material S. The recording material P on which the four color toner images are secondary-transferred is pressed and heated by a fixing device 35, so that the toner images are fixed on a surface of the recording material S. A separation roller 33 separates sheets of the recording material S, one by one, pulled out from a recording material cassette 32, and then feeds the recording material S to a registration roller pair 34. The registration roller pair 34 sends the recording materials to the secondary transfer portion T2 while being timed to the toner images on the intermediary transfer belt 8.

(Image Forming Portion)

The image forming portions 30Y, 30M, 30C and 30K have the substantially same constitution except that colors of toners used in developing devices 14Y, 14M, 14C and 14K, respectively, are yellow, magenta, cyan and black, respectively, which are different from each other. In the following, the image forming portion 10K is described, and redundant explanation about other image forming portions 30Y, 30M and 30C will be omitted.

The image forming portion 30K includes, at a periphery of the photosensitive drum 1K, a charging device 2K, an exposure device 3, the developing device 14K, a transfer roller 5K and drum cleaning device 6K. The photosensitive drum 1K is prepared by forming a photosensitive layer on an outer peripheral surface of an aluminum cylinder, and is rotated at a predetermined process speed. The charging device 2K electrically charges a surface of the photosensitive drum 1K to a negative potential uniformly. The exposure device 3 scans the surface of the photosensitive drum 1K with a laser beam, obtained by ON-OFF modulation of a scanning line image signal developed from an associated color image, through a rotating mirror, so that an electrostatic image is written (formed) on the photosensitive drum 1K. The developing device 14K develops the electrostatic image into a toner image by transferring the toner onto the photosensitive drum 1K. A fresh toner in an amount corresponding to an amount of the toner consumed in the developing device 14K by image formation is supplied from a toner cartridge 7K to the developing device 14K.

The transfer roller 5K presses the intermediary transfer belt 8 to form a transfer portion between the photosensitive drum 1K and the intermediary transfer belt 8. By applying a positive DC voltage to the transfer roller 5K, the negative toner image carried on the photosensitive drum 1K is transferred onto the intermediary transfer belt 8. The intermediary transfer belt 8 is extended around and supported by a tension roller 8*a*, a driving roller 8*b* also functioning as a secondary transfer opposite roller, and a stretching roller 8*c*, and is driven by the driving roller 8*b* to be rotated in an arrow C direction. A secondary transfer roller 8*e* contacts the intermediary transfer belt 8 supported at an inside surface by the driving roller 8*b* to form the secondary transfer portion T2. By applying a positive DC voltage to the secondary transfer roller 8*e*, the toner image on the intermediary transfer belt 8 is transferred onto the recording material S.

(Drum Cleaning Device)

Figure 2:
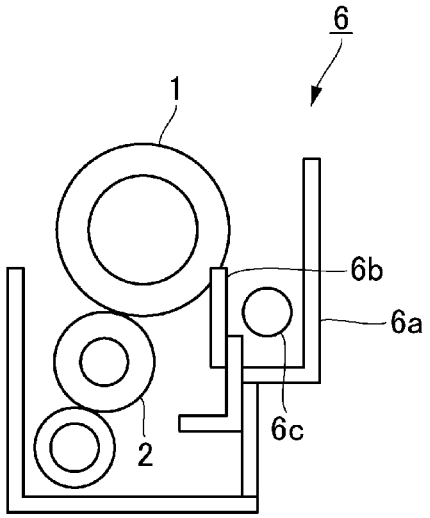
In FIG. 2, (a) is an illustration of a drum cleaning device as a developer collecting device, and (b) is a belt cleaning device as another developer collecting device.
Figure 2:
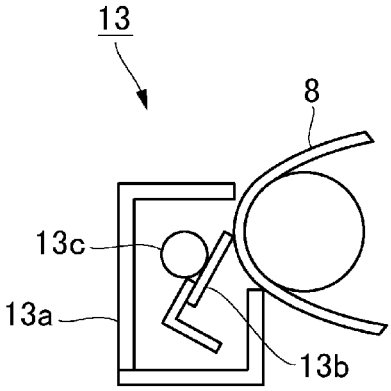

In FIG. 2, (a) and (b) are illustrations each showing a developer collecting device, in which (a) shows a drum cleaning device and (b) shows a belt cleaning device.

As shown in (a) of FIG. 2, the drum cleaning device 6 removes a transfer residual toner deposited on the photosensitive drum 1 by rubbing the photosensitive drum 1 with a cleaning blade 6*b*. In this embodiment, the drum cleaning device 6 is of a rubber blade type but is not limited to the rubber blade type.

The drum cleaning device 6 is prepared by providing, inside a cleaning container 6*a*, the cleaning blade 6*b* and a toner feeding screw 6*c* along a longitudinal direction of the cleaning container 6*a*. The cleaning blade 6*b* is an elastic blade using an urethane rubber, and an edge portion is center directionally contacted to the peripheral surface of the photosensitive drum 1. The cleaning blade 6*b* rubs the peripheral surface of the rotating photosensitive drum 1 and scrapes off the transfer residual toner, deposited on the peripheral surface of the photosensitive drum 1, into the cleaning container 6*a*. The toner feeding screw 6*c* is rotated to feed the scraped toner from a rear side to a front side in the cleaning container 6*a* with respect to a longitudinal direction. The toner fed to the front side is fed into a common collected toner feeding pipe 4 (FIG. 1) through a discharging opening provided in the front side of the cleaning container 6*a*.

(Belt Cleaning Device)

As shown in (b) of FIG. 2, a belt cleaning device 13 collects a transfer residual toner on the surface of the intermediary transfer belt 6 by rubbing the intermediary transfer belt 8 with a cleaning blade 13*b*. In this embodiment, the belt cleaning device 13 is of a rubber blade type but is not limited to the rubber blade type.

The belt cleaning device 13 is prepared by providing, inside a cleaning container 13*a*, the cleaning blade 13*b* and a toner feeding screw 13*c* along a longitudinal direction of the cleaning container 13*a*. The cleaning blade 13*b* is an elastic blade using an urethane rubber, and an edge portion is center directionally contacted to the peripheral surface of the intermediary transfer belt 8. The cleaning blade 13*b* rubs the peripheral surface of the rotating intermediary transfer belt 8 and scrapes off the transfer residual toner, deposited on the peripheral surface of the intermediary transfer belt 8, into the cleaning container 13*a*. The toner feeding screw 13*c* is rotated to feed the scraped toner from a rear side to a front side in the cleaning container 13*a* with respect to a longitudinal direction. The toner fed to the front side is fed into the common collected toner feeding pipe 4 (FIG. 1) through a discharging opening provided in the front side of the cleaning container 13*a*.

(Collected Toner Container)

FIG. 3 is an illustration of a structure of the collected toner container 10. In FIG. 3, (a) is a perspective view of an outer appearance of the collected toner container 10, and (b) is a vertical sectional view of the collected toner container 10 along a screw. As shown in FIG. 1, the collected toner container 10 collects the toner in a large amount in order to minimize the number of times of exchange for the purpose of reducing a running cost. The image forming apparatus 100 collects the collection toner in a large amount in the collected toner container 10 at the container accommodating portion 50 which is a space limited with downsizing of a whole structure.

As shown in (a) of FIG. 3, the collected toner container 10 is a hermetically sealed container having an outer appearance of a substantially rectangular parallelopiped prepared by air blow molding of soft plastic. The collected toner container 10 is 480 mm in length, 200 mm in width and 100 mm in height. The collected toner container 10 includes an opening 10*a* at an upper surface thereon in one end side. At the opening 10*a*, a shutter 41 which opens and closes in interrelation with a mounting and demounting operation of the collected toner container 10 relative to the image forming apparatus.

As shown in (b) of FIG. 3, a screw 10*b* provided in the collected toner container 10 is rotated by externally receiving a driving force to increase a toner collecting efficiency in the collected toner container 10. At an upper portion of an inside space of the collected toner container 10, the screw 10*b* for feeding the toner from one side toward the outer end side is disposed. The screw 10*b* is rotatably held by a bearing portion provided on a side wall of the collected toner container 10 in each of the one end side and the other end side. The screw 10*b* is prepared by injection molding of hard plastic. The screw 10*b* is formed to have a blade shape so that the screw 10*b* feeds the toner from the opening 10*a* toward a driving connection portion 42 with rotation thereof. The blade shape of the screw 10*b* is 20 mm in outer diameter, 8 mm in inner diameter and 20 mm in pitch. A shaft end portion of the screw 10*b* in the driving connection portion 42 side is projected from the collected toner container 10 toward the outside of the collected toner container 10, and the driving connection portion 42 is fixed on the projected shaft end portion. In the image forming apparatus side, a driving motor 44 provided with a pin 44*a* is disposed. The pin 44*a* rotationally drives the driving connection portion 42, so that the screw 10*b* is rotationally driven.

(Container Accommodating Portion)

Figure 5:
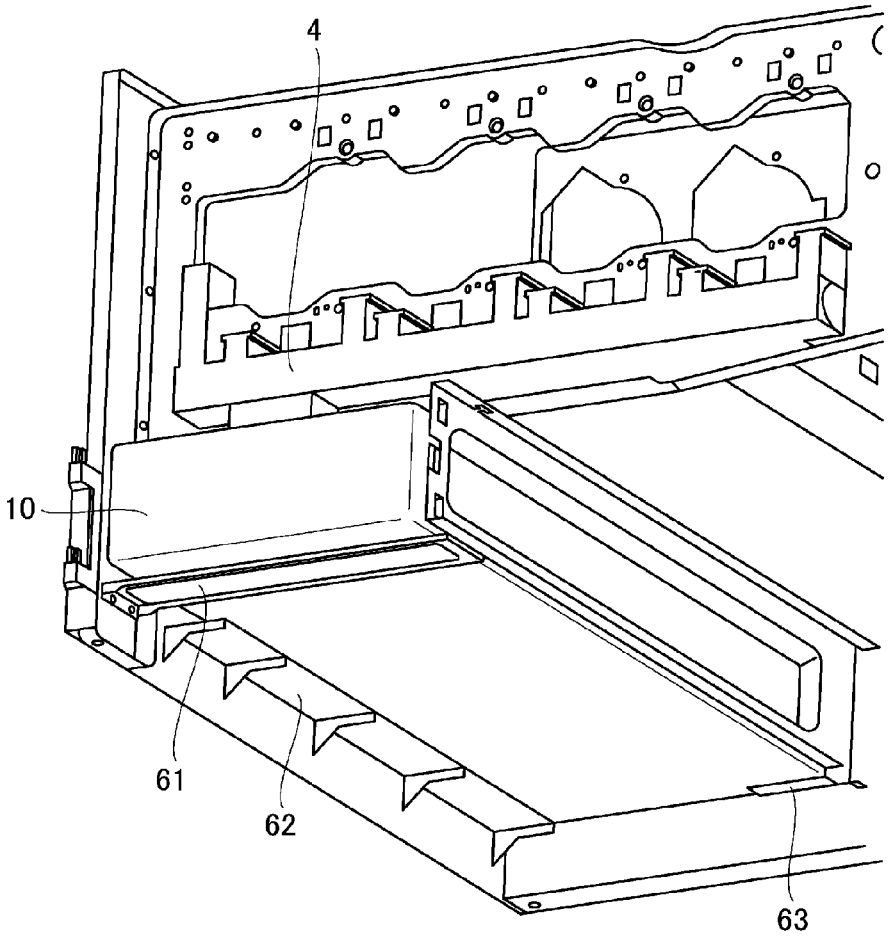
FIG. 5 is a perspective view of the container accommodating portion when a bottom of the container accommodating portion is seen from obliquely below the bottom.

FIG. 4 is an illustration of a structure of the container accommodating portion 50. FIG. 5 is a perspective view of the container accommodating portion 50 as seen from obliquely below a bottom of the container accommodating portion 50.

As shown in FIG. 4, the container accommodating portion 50 of the image forming apparatus 100 holds the collected toner container 10 in an insertable and pullable manner. The collected toner container 10 is detachably mounted into the container accommodating portion 50, and at a stage in which a collected toner amount reaches a predetermined amount, is pulled out from the container accommodating portion 50 and then is replaced with a fresh empty collected toner container 10.

As shown in FIG. 5, a bottom portion of the collected toner container 10 is supported by a main assembly frame 61 and a cover member 62. A bottom of the container accommodating portion 50 in an entrance side is the main assembly frame 61 of a steel material. The main assembly frame 61 is a rigid member, and therefore is not deformed by a weight of the collected toner container 10, thus keeping a height of the collected toner container 10 in a pulling-outside at a constant level.

On the other hand, a rear-side bottom of the container accommodating portion 50 is the cover member 61 which is formed of an L-angle material as a soft resin material and which supports the collected toner container 10 in a cantilever state. The cover member 62 lowers the collected toner container 10 in the rear side by elastic deformation of the cantilever by the weight of the collected toner container 10 in which the toner is accommodated a full state.

At a position lower than the cover member 62 in the rear side of the container accommodating portion 50, a supporting portion 63 formed of the same material with the material for the main assembly frame 61 is provided. The supporting portion 63 as an example of a limiting member is a rigid member, and therefore holds the rear-side height position of the collected toner container 10, lowered by the elastic deformation of the cover member 62, at a predetermined height.

(Collecting Container-Side Shutter)

Figure 6:
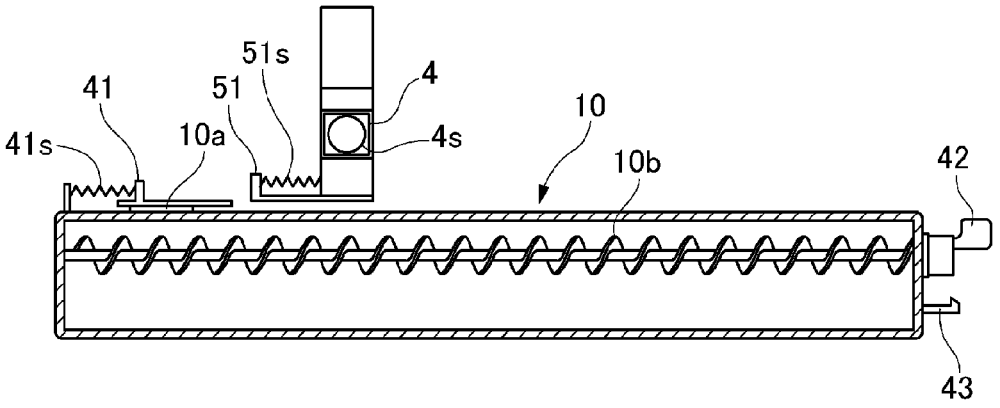
FIG. 6 is an illustration of a structure of a shutter.

FIG. 6 is an illustration of a structure of the shutter 41. As shown in FIG. 4, the shutter 41 is provided on the upper surface of the collected toner container 10 so as to prevent the toner from scattering to the outside of the collected toner container 10 through the opening 10*a*. The shutter 41 as an example of a container-side shutter member is disposed, at a connecting portion of the collected toner container 10 with the pipe 4, movably in the pulling-out direction of the collected toner container 10. A spring 41*s* as an example of a container-side urging member urges the shutter 41 in the pulling-out direction of the collected toner container 10. The shutter 41 opens against the urging by the spring 41*s* with an operation for pushing in the collected toner container 10 by guiding the collected toner container 10 by the container accommodating portion 50.

As shown in FIG. 6, the shutter 41 blocks the opening 10*a* of the collected toner container 10 taken out from the container accommodating portion 50, thus preventing leaking-out of the toner from the collected toner container 10 to the outside of the collected toner container 10. The shutter 41 permits flowing of the toner from the pipe 4 into the collected toner container 10 by opening the opening 10*a* of the collected toner container 10 inserted into the container accommodating portion 50. The shutter 41 is urged by the spring 41*s* in a closing direction of the opening 10*a*. The shutter 41 is contacted to a shutter 51 of the pipe 4 at a final stage in which the collected toner container 10 is inserted into the container accommodating portion 50, and then is opened against an urging force of the spring 41*s*. The shutter 41 automatically performs an opening and closing operation by following the mounting and demounting of the collected toner container 10 relative to the container accommodating portion 50, so that usability is improved.

In order to prevent toner scattering around the shutter 41 with high reliability, a thick sealing material is provided between the shutter 41 and the collected toner container 10. High elastic modulus is imparted to the spring 41*s* so that the shutter 41 can be closed by overcoming a frictional force of the sealing member. For that reason, in an empty state of the collected toner container 10, as shown in (b) of FIG. 3, there is a need to lock the locking claw 43 with the locking portion 53 of the container accommodating portion 50 so that the collected toner container 10 is not projected from the container accommodating portion 50 by the urging force of the spring 41*s*.

(Supply Patch-Side Shutter)

As shown in FIG. 6, the shutter 51 as an example of a supply path-side shutter member is disposed, at a connecting portion of the pipe 4 with the collected toner container 10, movably in the pulling-out direction of the collected toner container 10. A spring 51*s* as an example of a supply-side urging member urges the shutter 51 in the pulling-out direction of the collected toner container 10. The shutter 51 opens against the urging by the spring 51*s* with an operation for pushing in the collected toner container 10 by guiding the collected toner container 10 by the container accommodating portion 50.

The shutter 51 blocks an end portion of the pipe 4 from which the collected toner container 10 is demounted, thus preventing leaking-out of the toner from the end portion of the pipe 4. The shutter 51 is urged by the spring 51*a* in a closing direction of the end portion of the pipe 4. The shutter 51 is contacted to the shutter 41 of the collected toner container 10 at a final stage in which the collected toner container 10 is inserted into the container accommodating portion 50, and then is opened against an urging force of the spring 51*s*. In an empty state of the collected toner container 10, as shown in (b) of FIG. 3, there is a need to lock the locking claw 43 with the locking portion 53 of the container accommodating portion 50 so that the collected toner container 10 is not projected from the container accommodating portion 50 by the urging force of the spring 51*s*. The shutters 41 and 51 are, when the collected toner container 10 is pulled out, urged by the springs 41*s* and 51*s* and are automatically placed in the closed state.

(Supply Path)

As shown in (b) of FIG. 3, inside the pipe 4, a feeding screw 4*s* for feeding the collection toner with rotation thereof is provided. As shown in FIG. 1, the container accommodating portion 50 is provided below the pipe 4 in the casing of the image forming apparatus 100. The toners discharged from the drum cleaning devices 6Y, 6M, 6C and 6K are merged with the collection toner discharged from the belt cleaning device 13 in the pipe 4. The merged collection toner is fed inside the pipe 4 toward the collected toner container 10 and is supplied into the collected toner container 10.

(Mounting Operation of Collected Toner Container)

Figure 7:
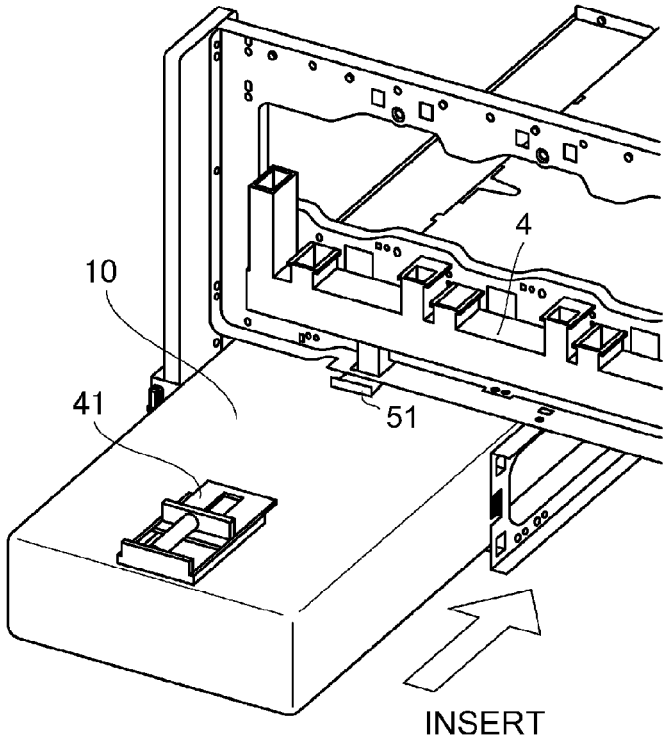
In FIG. 7, (a) and (b) are illustrations of a mounting procedure of the collected toner container.
Figure 7:
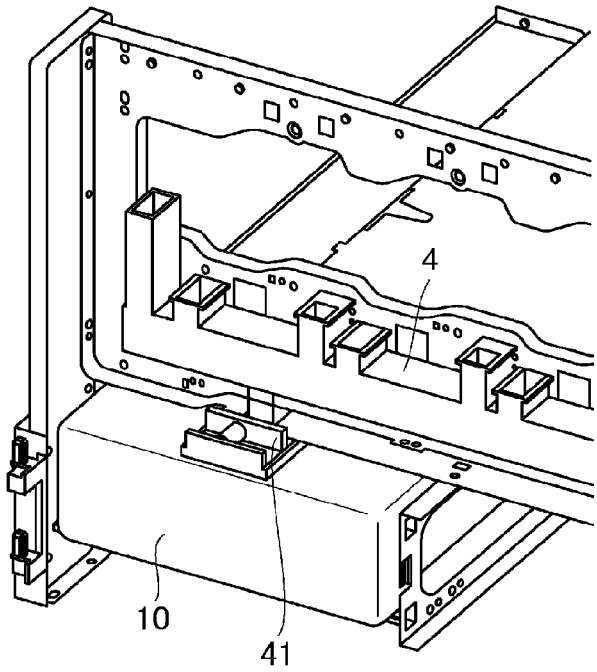

In FIG. 7, (a) and (b) are illustrations of a mounting procedure of the collected toner container 10. In FIG. 7, (a) is a perspective view of the collected toner container 10 during insertion, and (b) is a perspective view of the collected toner container 10 in an inserted state.

As shown in FIG. 4, the empty collected toner container 10 is moved in an arrow direction and is inserted into the container accommodating portion 50. As shown in (a) of FIG. 7, at the time when the collected toner container 10 is inserted in the arrow direction, the shutter 41 seals the opening 10*a* of the collected toner container 10. The shutter 51 seals the end portion of the pipe 4.

As shown in (b) of FIG. 3, in a state in which the collected toner container 10 is completely accommodated in the container accommodating portion 50, the locking claw 43 of the collected toner container 10 is locked with the locking portion 53, thus positioning and holding the collected toner container 10 in the container accommodating portion 50. In the state in which the collected toner container 10 is completely accommodated in the container accommodating portion 50, the shutter 41 is in an open state. Further, with respect to also the pipe 4, the shutter 51 is in an open state in interrelation with the shutter 41.

The shutters 41 and 51 are kept in the open state by being pressed in the insertion direction of the collected toner container 10. In a state in which the collected toner container 10 is inserted in the container accommodating portion 50*m*, by reaction forces of the springs 41*s* and 51*s*, the collected toner container 10 is always urged in a slip-out direction from the container accommodating portion 50.

(Locking Portion)

As shown in (b) of FIG. 3, the collected toner container 10 includes, at a surface when the drive connection portion 42, the hook-shaped locking claw 43 elastically deformable vertically downward. In this embodiment, the locking claw 43 is disposed at an end surface of the collected toner container 10 with respect to the insertion direction shown in FIG. 4.

The hook-shaped locking portion 53 for locking with the locking claw 43 is disposed at a position where the locking portion 53 opposes the end surface of the collected toner container 10 with respect to the insertion direction in the container accommodating portion 50. The locking portion 53 is elastically deformable vertically upward.

The collected toner container 10 includes the locking claw 43 elastically deformable vertically downward in the other end side. In this embodiment, the locking claw 43 is disposed in the end side with respect to the insertion direction in FIG. 4.

When the collected toner container 10 is inserted into the container accommodating portion 50, the collected toner container 10 and the container accommodating portion 50 slide with each other along inclined surfaces thereof formed in a claw shape, and thereafter are locked with each other. By the locking, the collected toner container 10 resists a force acting in the slip-out direction from the container accommodating portion 50. At a surface opposing the other end side of the collected toner container 10 in the container accommodating portion 50, the locking portion 53 locked with the locking claw 43 is provided and is formed in the claw shape which is elastically deformable vertically upward. When the collected toner container 10 is inserted into the container accommodating portion 50, the collected toner container 10 and the container accommodating portion 50 slide with each other along the claw-shaped inclined surface, and thereafter are locked with each other.

(Exchange Timing of Collected Toner Container)

The collected toner container 10 is demounted from the apparatus main assembly in a state in which the collected toner amount reaches a predetermined amount. In this embodiment, transmitted light passing through a transparent window provided at each of a plurality of positions of the collected toner container 10 is detected. At the time when all the transparent windows are in a light-blocking state, a full state of the toner inside the collected toner container 19 is discriminated, and then an exchange-requiring massage is displayed on an unshown operating panel of the image forming apparatus. Incidentally, a toner powder surface may also be detected by providing the collected toner container 10 with a full-state sensor. In the image forming apparatus, a cumulative supply amount of the toner or a cumulative number of sheets subjected to image formation is counted, and then discrimination such that the toner is full may also be made at the time when the count reaches a predetermined cumulative value.

(Locking Releasing Mechanism)

As shown in FIG. 5, with respect to the empty collected toner container 10, the cover member 62 is not elastically deformed, and therefore the surface of the cover member 62 and the surface of the main assembly frame 61 contacted to the bottom of the collected toner container 10 are on the same plane at the same height. At this time, as shown in (b) of FIG. 3, the locking claw 43 is deeply locked with the locking portion 53, so that the force acting in the slip-out direction of the collected toner container 10 by the urging forces of the springs 41*s* and 51*s* is suppressed. Further, the weight of the empty collected toner container 10 is light, and therefore when the driving connection portion is driven, a force in a thrust direction acts on the collected toner container 10, so that the collected toner container 10 is pushed out and thus there is a possibility that locking between the driving connection portion 42 and the pin 44*a* is released (eliminated). Also the force acting on the driving connection portion 42 in the thrust direction is received by the locking between the locking claw 43 and the locking portion 53, so that the pushing-out of the collected toner container 10 is prevented.

As shown in (b) of FIG. 3, in a state in which the toner is not so contained in the collected toner container 10, the weight of the collected toner container 10 is light and thus there is a possibility that the collected toner container 10 is moved by vibration of the main assembly of the image forming apparatus to disconnect the driving connection portion 42 and then the screw 10*b* is stopped. When the screw 10*b* is stopped, the toner is not fed inside the collected toner container 10 and is stagnated in the neighborhood of the opening 10*a*, so that there is a possibility that the toner starts to overflow into the image forming apparatus. For this reason, the locking claw 43 and the locking portion 53 are locked with each other to prevent the collected toner container 10 from moving due to vibration of the main assembly of the image forming apparatus.

As shown in FIG. 5 with reference to (b) of FIG. 3, the weight of the collected toner container 10 in a full state with the toner is heavier than the weight of the empty collected toner container 10. At this time, in the opening 10*a* side of the collected toner container 10, the collected toner container 10 is kept at the same level, but in the driving connection portion 42 side of the collected toner container 10, the cover member 62 is elastically deformed by the weight of the collected toner container 10 and therefore the position of the collected toner container 10 is lowered vertically downward.

As shown in FIG. 6, the position of the collected toner container 10 lowered vertically downward is limited by the supporting portion 63 to a certain level. The supporting portion 63 prevents excessive lowering of the collected toner container 10 in the driving connection portion 42 side.

In this embodiment, a difference in height between the main assembly frame 61 and the supporting portion 63 is larger than a locking width between the locking claw 43 and the locking portion 53. For this reason, in the state in which the collected toner container 10 is lowered vertically downward in the driving connection portion 42 side, the locking between the locking claw 43 of the collected toner container 10 and the locking portion 53 of the container accommodating portion 50 is completely released.

When the collected toner container 10 is in the full state with the toner, the locking between the locking claw 43 and the locking portion 53 is eliminated, and therefore, compared with the locked state, the user is capable of pulling out the collected toner container 10 from the container accommodating portion 50 without difficulty.

In this embodiment, an accumulated toner amount when the collected toner container 10 is in the full state in about 3 kg. The sum of forces in the slip-out direction of the collected toner container 10 by the shutters 41 and 51 is about 10 N (1 kgf). A thrust force acting on the collected toner container 10 when the driving connection portion 42 is driven is about 3 N (0.3 kgf). A force required to pull out the collected toner container 10, placed in the full state, from the container accommodating portion 50 is about 20 N (2 kgf).

$$20\ N > (10\ N + 3\ N)$$

For this reason, during operation of the image forming apparatus 100, the collected toner container 10 is not slipped out from the container accommodating portion 50.

Effect of Embodiment 1

In the image forming apparatus in this embodiment, when the collected toner container 10 is inserted into the container accommodating portion 50, the locking claw 43 and the locking portion 53 lock with each other so that the slip-out of the collected toner container 10 by the reaction force is prevented.

In the image forming apparatus in this embodiment, a limiting member such as a lever for preventing the slip-out is not used, and therefore there is no need for the user to move the lever while suppressing the slip-out of the collected toner container 10 from the image forming apparatus main assembly.

In the image forming apparatus in this embodiment, at the time when the collected toner container 10 is pulled out from the container accommodating portion 50, even when the toner enters the collected toner container 10 to be increased in weight, constraint with respect to the container accommodating portion 50 is eliminated, and therefore the collected toner container 10 can be easily pulled out. There is no need to apply a force exceeding a force necessary to pull out the collected toner container 10, increased in weight by incorporation of the toner, from the container accommodating portion 50.

In the image forming apparatus in this embodiment, the collected toner container 10 can be fixed at a predetermined position of the image forming apparatus main assembly with reliability. It is possible to achieve improvement in usability by reducing an operation load when the collected toner container 10 is pulled out from the container accommodating portion 50.

In the image forming apparatus in this embodiment, when the collected toner container 10 is filled with the toner to be increased in weight, the bottom of the container accommodating portion 50 is elastically deformed, so that the position of the collected toner container 10 is moved vertically downward to eliminate the locking between the locking claw 43 and the locking portion 53. For this reason, there is no need to apply an excessive force when the collected toner container 10 is demounted. It is possible to provide the image forming apparatus including the detachably mountable collected toner container with an alleviated user load.

In this embodiment, an example in which the collected toner container is urged by the springs for urging the shutters 41 and 51 is described but the present invention is not limited thereto. Further, the urging member may also have a constitution free from the shutter, and for example may also be provided for generating an assisting force during demounting of the collected toner container. Further, in order to suppress play, the urging member for urging the collected toner container in the demounting direction may also be provided.

Embodiment 2

Figure 8:
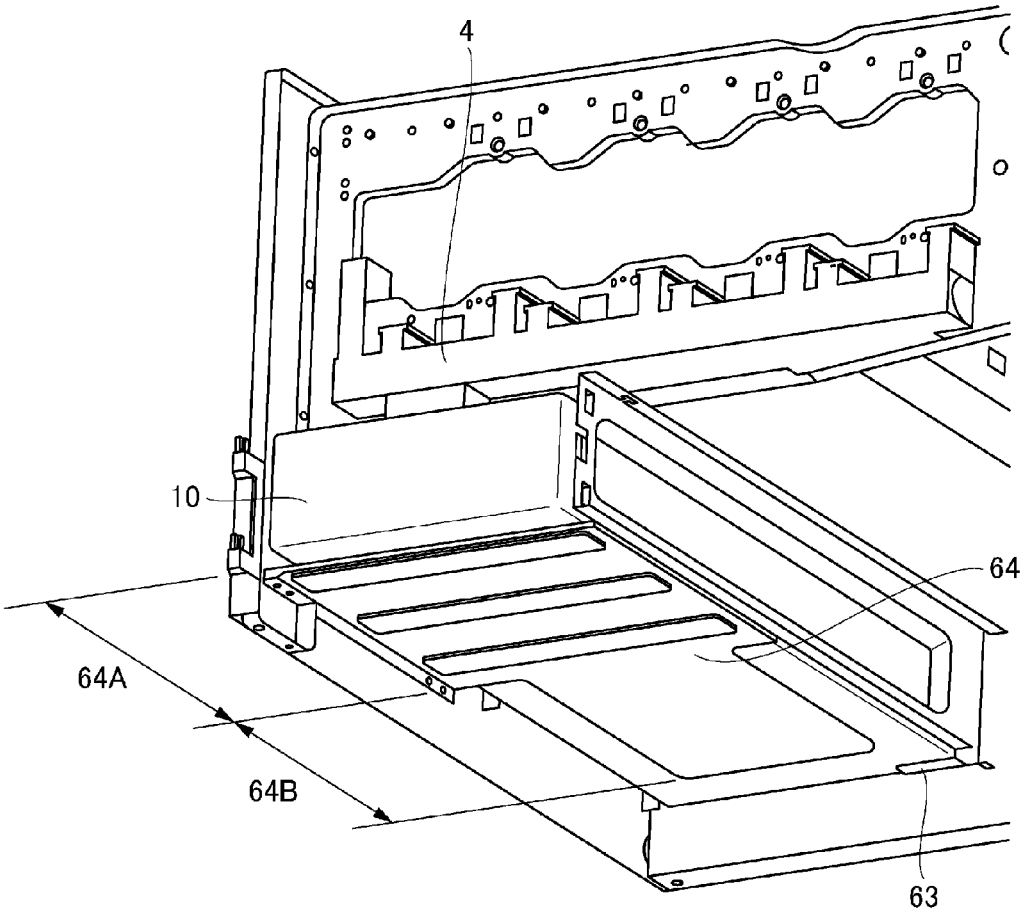
FIG. 8 is an illustration of a structure of a container accommodating portion in Embodiment 2.

FIG. 8 is an illustration of a structure of a container accommodating portion in this embodiment. Embodiment 1 and Embodiment 2 are only different in constitution of the bottom of the container accommodating portion 50 for supporting the collected toner container 10, and other constitutions such as the collected toner container 10 and the like are the same. Accordingly, in FIG. 8, constitutions common to Embodiments 1 and 2 are represented by reference numerals or symbols common to FIGS. 5 and 8 and will be omitted from redundant description.

As shown in FIG. 5, in Embodiment 1, the main assembly frame 61 for supporting the collected toner container 10 and the cover member 62 where constituted by separate members different in material. As shown in FIG. 8, in Embodiment 2, a constitution for supporting the collected toner container 10 is constituted by a single member.

As shown in FIG. 8, an integral cover member 64 for supporting the collected toner container 10 is formed with a thin steel plate and is provided with a region, in which the cover member 64 is elastically deformable in a cantilever shape, in a lowering side where the collected toner container 10 is provided with the locking claw 43. The cover member 64 includes a region 64A where the cover member 64 is less elastically deformed and a region 64B where elastic deformation of the cover member 64 is permitted.

Embodiment 3

Figure 9:
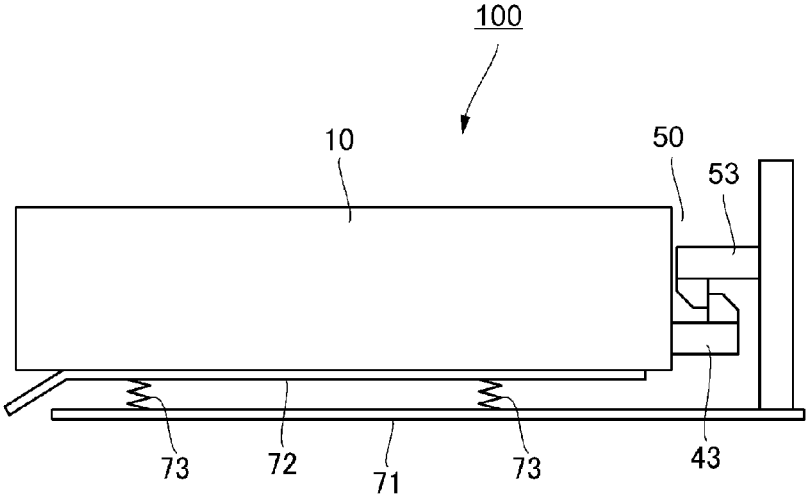
FIG. 9 is an illustration of a structure of a container accommodating portion in Embodiment 3.

FIG. 9 is an illustration of a structure of a container accommodating portion in this embodiment. Embodiment 1 and Embodiment 3 are only different in constitution of the bottom of the container accommodating portion 50 for supporting the collected toner container 10, and other constitutions such as the collected toner container 10 and the like are the same. Accordingly, in FIG. 9, constitutions common to Embodiments 1 and 3 are represented by reference numerals or symbols common to FIGS. 5 and 9 and will be omitted from redundant description.

As shown in FIG. 5, in Embodiment 3, the entire bottom of the container accommodating portion 50 for supporting the collected toner container 10 is urged vertically from below toward above. The collected toner container 10 is placed on a cover member 72. The cover member 72 is urged vertically upward from a frame portion 71 of the image forming apparatus by a plurality of springs 73. When the toner is accumulated in the collected toner container 10, the weight of the collected toner container 10 is increased and thus the cover member 72 is lowered in a vertically downward direction, so that locking between the locking claw 43 and the locking portion 53 is eliminated.

A lowering amount of the cover member 72 is obtained from a relationship between elastic modulus of the springs 73 and the weight of the collected toner container 10. The lowering amount of the cover member 72 is adjusted by properly selecting the elastic modulus of the springs 73. By accumulating the toner in the collected toner container 10 to compress the springs 73 to a position where the locking between the locking claw 43 and the locking portion 53 is eliminated, similarly as in Embodiment 1, the locking between the locking claw 43 and the locking portion 53 is eliminated, and thus an operation load when the collected toner container 10 is pulled out from the container accommodating portion 50 can be alleviated.

Other Embodiments

The present invention can be carried out also in other embodiments in which a part or all of constitutions in the above-described embodiments are replaced with alternative constitutions so long as the constraint with respect to the casing of the image forming apparatus is eliminated with weight increase of the collected toner container. The toner may also be dispersed in the collected toner container by using, e.g., a vibrator other than a screw. With respect to dimensions, materials, shapes and relative arrangement of the constituent elements described in Embodiments 1 to 3, the scope of the present invention is not intended to be limited thereto unless otherwise particularly specified.

In Embodiment 1, the developer collecting container for accumulating the toner collected from the photosensitive drum and the intermediary transfer belt was described, but the present invention can be carried out also in the developer collecting container for accumulating the toner collected by the blade cleaning device, but the present invention can be carried out also in a developer collecting container for accumulating the toner collected by a brush cleaning device or an electrostatic cleaning device.

The developer collecting device is not limited to the form in which the developer collecting container is mounted in the image forming apparatus, but may also be carried out as a single processing unit or a component to be connected with another processing unit. In the above-described embodiments, only a principal portion relating to toner image formation and transfer is described, but the present invention can be carried out in various uses such as printers, various printing machines, copying machines, facsimile machines, and multifunction machines, by adding necessary equipment, devices and casing structures.

The supporting portion 63 may also limit (regulate) the lowering of the collected toner container 10 at a height position where the locking claw 43 and the locking portion 53 are loosely locked so as to be capable of being lock-released with the pulling-out of the collected toner container 10.

In the image forming apparatus of the present invention, a releasing (eliminating) mechanism alleviates a locking-releasing force of the locking portion in response to the weight increase of the collecting container with accumulation of the developer. For this reason, the locking portion exhibits a strong locking force with respect to the empty collecting container, while the exchange of the collecting container can be facilitated by alleviating the locking force with respect to the collecting container in which the developer is accumulated in the full state.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 098772/2013 filed May 8, 2013, which is hereby incorporated by reference.

What is claimed is:

1. An image forming apparatus comprising:

a collecting container, provided detachably mountable to a casing of said image forming apparatus, capable of collecting a developer;

a locked portion provided on said collecting container;

a locking portion, provided on the casing, for locking said collecting container to prevent said collecting container from moving in a demounting direction by being locked with said locked portion when said collecting container is mounted in a main assembly of said image forming apparatus in an empty state; and a supporting portion for supporting said collecting container, said supporting portion being provided so as to be displaceable, by a weight of the developer collected by said collecting container, in a direction such that locking with said locking portion is released.

2. An image forming apparatus according to claim 1, wherein when said locked portion is moved downward, a degree of the locking with said locking portion is decreased, and a supporting position of said collecting container by said supporting portion is lowered with a weight increase of said collecting container.

3. An image forming apparatus according to claim 1, wherein said supporting portion guides said collecting container so as to be pullable in a horizontal direction and has a structure such that a rear side thereof with respect to a pulling-cut direction is displaceable with a weight increase of said collecting container in a state in which a height position of said collecting container in a front side of said collecting container with respect to the pulling-cut direction is maintained.

4. An image forming apparatus according to claim 1, wherein said supporting portion includes an elastic member which supports a bottom of said collecting container along a pulling-out direction of said collecting container in a cantilever state and which is displaceable toward a rear side of said collecting container with respect to a pulling direction with a weight increase of said collecting container.

5. An image forming apparatus according to claim 1, wherein said supporting portion includes a limiting member for limiting lowering of said collecting container at a height position where said locked portion and said locking portion are loosely locked so as to be capable of being lock-released with pulling-out of said collecting container.

6. An image forming apparatus according to claim 1, wherein said locked portion is disposed at an upstream end surface of said collecting container with respect to a pulling-out direction.

7. An image forming apparatus according to claim 1, further comprising an urging member for urging said collecting container in the demounting direction.

8. An image forming apparatus according to claim 7, wherein said urging member urges a shutter member for opening and closing a collecting opening of said collecting container.

* * * * *